US008366483B2

(12) United States Patent
Hardy et al.

(10) Patent No.: US 8,366,483 B2
(45) Date of Patent: Feb. 5, 2013

(54) RADIO FREQUENCY CONNECTOR ASSEMBLY

(75) Inventors: Douglas John Hardy, Middletown, PA (US); John Wesley Hall, Harrisburg, PA (US); Sean Patrick McCarthy, Palmyra, PA (US); Olivier Irene Maurice De Cloet, Lorsch (DE); Stefan Konrad Nagel, Stuttgart (DE)

(73) Assignees: Tyco Electronics Corporation, Berwyn, PA (US); Tyco Electronics AMP GmbH, Bensheim (DE)

( * ) Notice: Subject to any disclaimer, the term of this patent is extended or adjusted under 35 U.S.C. 154(b) by 89 days.

(21) Appl. No.: 13/021,170

(22) Filed: Feb. 4, 2011

(65) Prior Publication Data

US 2012/0202372 A1 Aug. 9, 2012

(51) Int. Cl.
*H01R 9/05* (2006.01)

(52) U.S. Cl. ..... 439/585; 439/578

(58) Field of Classification Search ..... 439/578–585
See application file for complete search history.

(56) References Cited

U.S. PATENT DOCUMENTS 4,593,964 A * 6/1986 Forney et al. ..... 439/580
6,210,223 B1 * 4/2001 Aoyama et al. ..... 439/585
6,554,644 B2 * 4/2003 Koide ..... 439/585
6,808,417 B2 * 10/2004 Yoshida ..... 439/585
7,635,282 B2 * 12/2009 Sakamoto ..... 439/578
7,794,274 B2 * 9/2010 Phillips, Jr. ..... 439/578
7,980,894 B1 * 7/2011 Hall et al. ..... 439/585

OTHER PUBLICATIONS

Drawing No. C-1438910, Jack Subassembly, RG-58 or RG-58 LL, SMB, Rev. C, Mar. 7, 2007, 1 pg, Tyco Electronics, Harrisburg, PA.
Drawing No. C-1438911, Jack Kit, Unassembled, 1 Position, Mini 59, RG-58 or RG-58 LL, FAKRA, SMB, Rev. F1, Jun. 30, 2010, 2 pgs, Tyco Electronics, Harrisburg, PA.
Drawing No. C-1438918, Plug Subassembly, RG-58 or RG-58 LL, SMB, Rev. C., Mar. 7, 2007, 1 pg, Tyco Electronics, Harrisburg, PA.
Drawing No. C-1438919, Plug Kit, Unassembled, 1 Position, Mini 59, RG-58 or RG-58 LL, 180 Degree, FAKRA, SMB, Rev. F, Aug. 13, 2008, 2 pgs, Tyco Electronics, Harrisburg, PA.
Drawing No. C-1488499, Ferrule, RG-58 LL and RG-58, Rev. 0, Aug. 6, 2003, 1 pg, Tyco Electronics, Harrisburg, PA.
Drawing No. C-1488570, Jack Kit, Unassembled, HF, Rev. B5, Dec. 23, 2010, 1 pg, Tyco Electronics Czech, s.r.o, CZ-664 34, Kurim.
Drawing No. C-1488571, Plug Kit, Unassembled HF, FAKRA II, Rev. C1, Dec. 23, 2010, 1 pg, Tyco Electronics Czech, s.r.o, CZ-664 34, Kurim.
Drawing No. C-1719795, Plug Kit, Unassembled, HF, FAKRA II, Rev. D1, Dec. 23, 2010,1 pg, Tyco Electronics Czech, s.r.o, CZ-664 34, Kurim.

* cited by examiner

*Primary Examiner* — Thanh Tam Le

(57) ABSTRACT

A connector assembly includes a center contact configured to be terminated to a center conductor of a cable. A dielectric holds the center contact. A stamped and formed outer contact surrounds the dielectric and the center contact. The outer contact is configured to be terminated to a braid of the cable. A stamped and formed outer ferrule surrounds at least a portion of the outer contact such that the braid is sandwiched between the outer ferrule and the outer contact.

22 Claims, 8 Drawing Sheets

RADIO FREQUENCY CONNECTOR ASSEMBLY

BACKGROUND OF THE INVENTION

The subject matter herein relates generally to connector assemblies.

Radio frequency (RF) connector assemblies have been used for numerous applications including military applications and automotive applications, such as global positioning systems (GPS), antennas, radios, mobile phones, multimedia devices, and the like. The connector assemblies are typically coaxial cable connectors that are provided at the end of coaxial cables.

In order to standardize various types of connector assemblies, particularly the interfaces for such connector assemblies, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. Like jack keys can only be connected to like plug keyways in FAKRA connectors. Secure positioning and locking of connector housings is facilitated by way of a FAKRA defined catch on the jack housing and a cooperating latch on the plug housing.

The connector assemblies include a center contact and an outer contact that provides shielding for the center contact. The outer contact is typically manufactured from a zinc die-cast or screw machined part, which is expensive to manufacture. The connector assemblies also include ferrules that are terminated to the cables. The ferrules are typically manufactured by a drawn method or screw machining, which may be expensive to manufacture.

A need remains for a connector assembly that may be manufactured in a cost effective and reliable manner. Additionally, a need remains for a connector assembly that may utilize less expensive parts, such as stamped and formed parts, in existing outer housings and locks made for die-cast parts.

BRIEF DESCRIPTION OF THE INVENTION

In one embodiment, a connector assembly is provided having a center contact configured to be terminated to a center conductor of a cable. A dielectric holds the center contact. A stamped and formed outer contact surrounds the dielectric and the center contact. The outer contact is configured to be terminated to a braid of the cable. A stamped and formed outer ferrule surrounds at least a portion of the outer contact such that the braid is sandwiched between the outer ferrule and the outer contact.

In another embodiment, a connector assembly is provided having a center contact configured to be terminated to a center conductor of a cable. A dielectric holds the center contact. An outer contact surrounds the dielectric and the center contact. The outer contact is configured to be terminated to a braid of the cable. A cavity insert surrounds the outer contact and is axially secured with respect to the outer contact to hold the outer contact therein. The cavity insert has a flange. The center contact, dielectric, outer contact and cavity insert define a subassembly. The connector assembly includes an outer housing having a cavity that receives the subassembly. The flange is locked into the outer housing to hold the axial position of the subassembly within the cavity.

In a further embodiment, a connector assembly is provided having a center contact configured to be terminated to a center conductor of a cable. A dielectric holds the center contact. An outer contact surrounds the dielectric and the center contact. The outer contact has an inner ferrule segment that is configured to be terminated to a braid of the cable. The inner ferrule segment has an axially extending gap. The size of the gap is controllable to control an impedance of the connector. An outer ferrule surrounds the inner ferrule segment of the outer contact such that the braid is sandwiched between the outer ferrule and the inner ferrule. The outer ferrule is crimped to control the size of the gap in the inner ferrule segment.

DETAILED DESCRIPTION OF THE INVENTION

Figure 1:
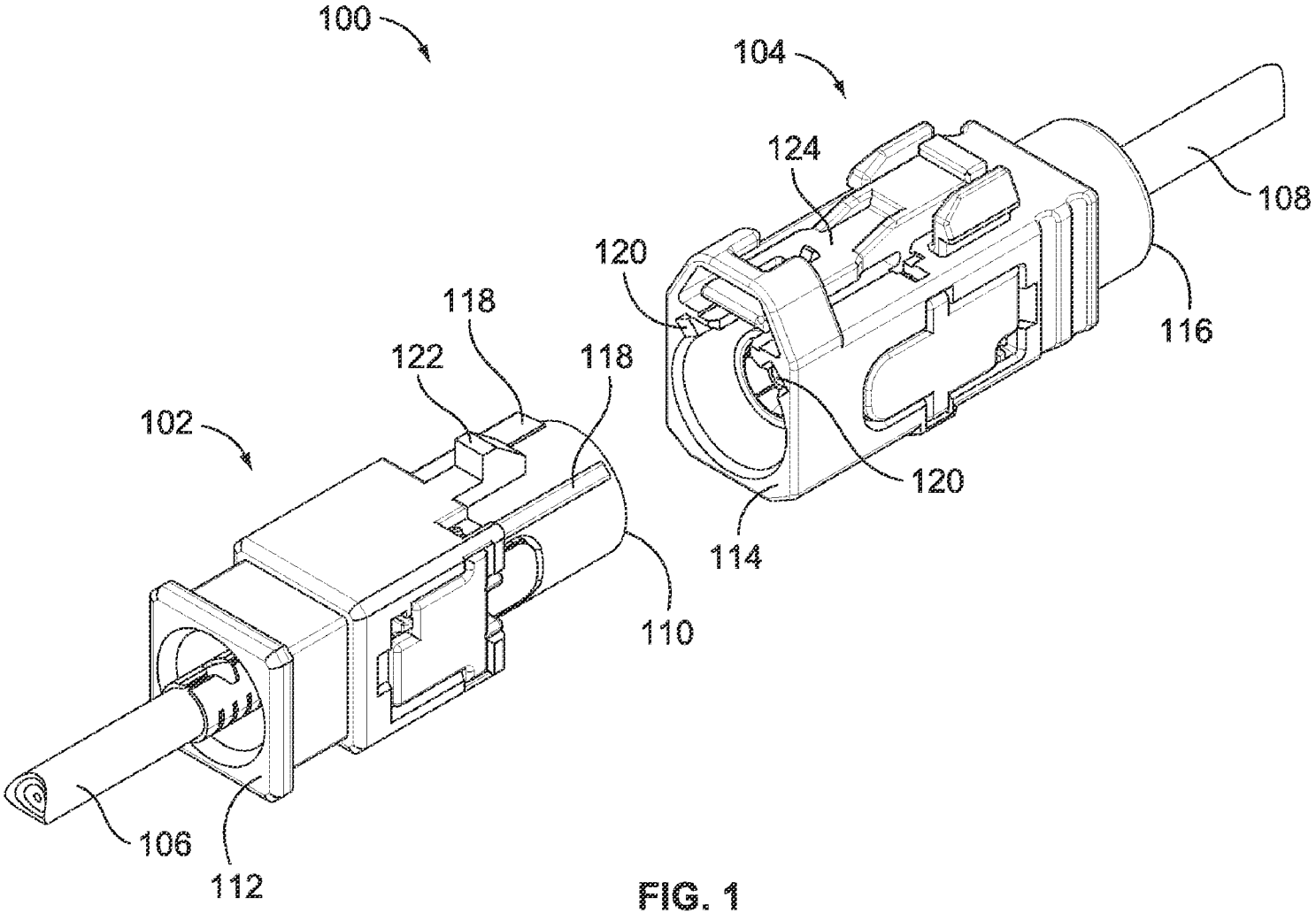
FIG. 1 illustrates a connector system formed in accordance with an exemplary embodiment including a jack assembly and a plug assembly.

FIG. 1 illustrates a connector system 100 formed in accordance with an exemplary embodiment. The connector system 100 includes a first connector assembly 102 and a second connector assembly 104. In the illustrated embodiment, the first connector assembly 102 constitutes a jack assembly and may be referred to as a jack assembly 102. The second connector assembly 104 constitutes a plug assembly and may be referred to as a plug assembly 104. The jack assembly 102 and the plug assembly 104 are configured to be connected together to transmit electrical signals therebetween. The jack assembly 102 is terminated to a cable 106. The plug assembly 104 is terminated to a cable 108. In an exemplary embodiment, the cables 106, 108 are coaxial cables. Signals transmitted along the cables 106, 108 are transferred through the jack assembly 102 and plug assembly 104 when connected.

The jack assembly 102 has a mating end 110 and a cable end 112. The jack assembly 102 is terminated to the cable 106 at the cable end 112. The plug assembly 104 has a mating end 114 and a cable end 116. The plug assembly 104 is terminated to the cable 108 at the cable end 116. During mating, the mating end 110 of the jack assembly 102 is plugged into the mating end 114 of the plug assembly 104.

In the illustrated embodiment, the jack assembly 102 and the plug assembly 104 constitute FAKRA connectors which are RF connectors that have an interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) that feature snap-on coupling and are designed to operate at either 50 Ohm or 75 Ohm impedances. The connector system 100 may utilize other types of connectors other than the FAKRA connectors described herein.

The jack assembly 102 has one or more keying features 118 and the plug assembly 104 has one or more keying features 120 that correspond with the keying features 118 of the jack assembly 102. In the illustrated embodiment, the keying features 118 are ribs and the keying features 120 are channels that receive the ribs. Any number of keying features may be provided, and the keying features may be part of the standardized design of the FAKRA connector.

The jack assembly 102 has a latching feature 122 and the plug assembly 104 has a latching feature 124. The latching feature 122 is defined by a catch and the latching feature 124 is defined by a latch that engages the catch to hold the jack assembly 102 and the plug assembly 104 mated together.

Figure 2:
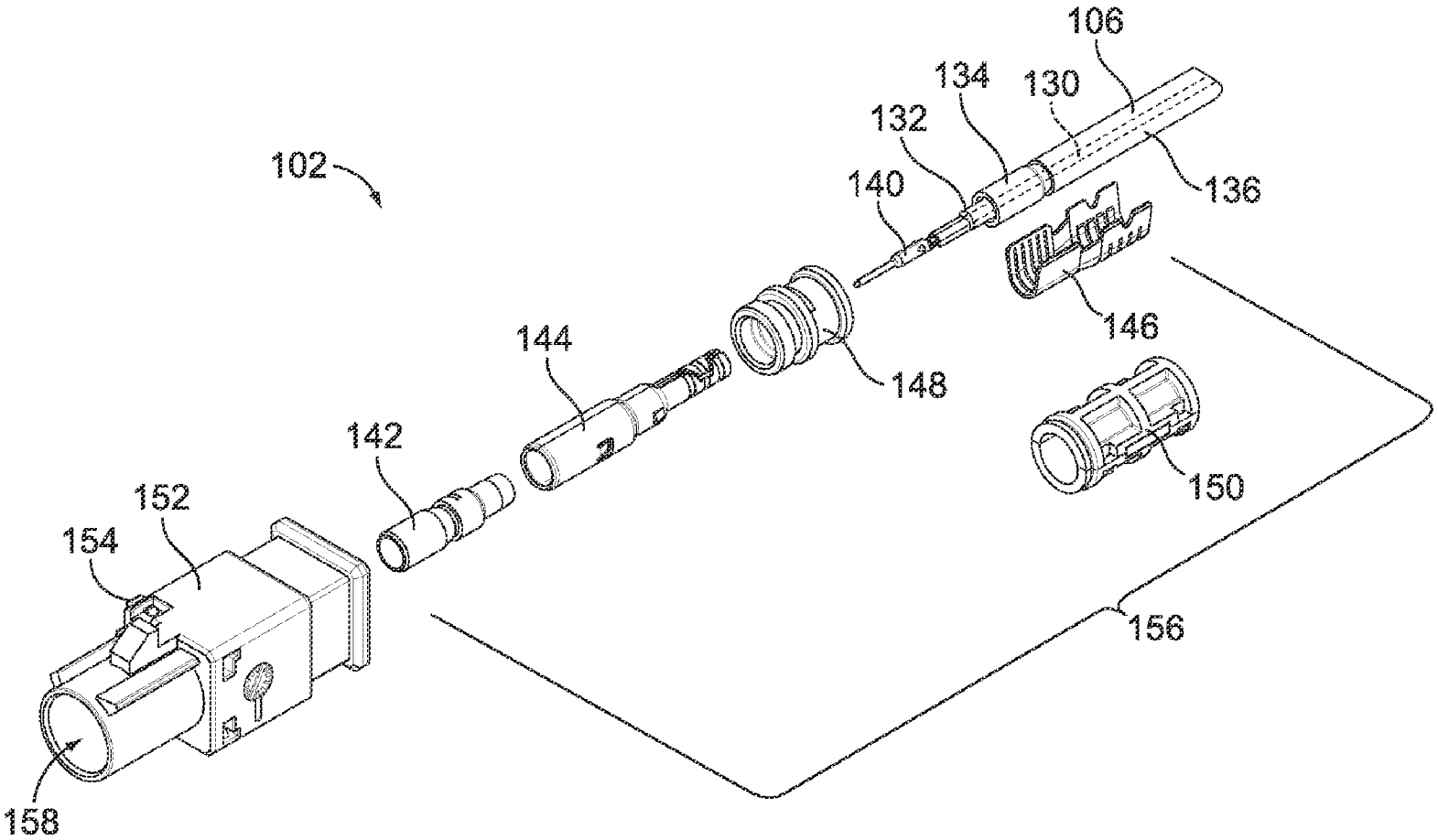
FIG. 2 is an exploded view of the jack assembly shown in FIG. 1.

FIG. 2 is an exploded view of the jack assembly 102 and the cable 106. The cable 106 is a coaxial cable having a center conductor 130 surrounded by a dielectric 132. A cable braid 134 surrounds the dielectric 132. The cable braid 134 provides shielding for the center conductor 130 along the length of the cable 106. A cable jacket 136 surrounds the cable braid 134.

The jack assembly 102 includes a center contact 140, a dielectric 142, an outer contact 144, an outer ferrule 146, a cavity insert 148, an optional cable insert 150 and an outer housing 152. In the illustrated embodiment, the center contact 140 constitutes a pin contact, however other types of contacts are possible in alternative embodiments. The center contact 140 is terminated to the center conductor 130 of the cable 106. For example, the center contact 140 may be crimped to the center conductor 130.

The dielectric 142 receives and holds the center contact 140 and possibly a portion of the center conductor 130. The outer contact 144 receives the dielectric 142 therein. The outer contact 144 surrounds the dielectric 142 and at least a portion of the center contact 140. The outer contact 144 provides shielding for the center contact 140, such as from electromagnetic or radio frequency interference. In an exemplary embodiment, the outer contact 144 is stamped and formed, which makes the outer contact 144 less expensive than manufacturing the outer contact by other methods, such as die-casting or screw machining. The dielectric 142 electrically isolates the center contact 140 from the outer contact 144. The outer contact 144 is configured to be electrically connected to the cable braid 134 thereby providing continuous shielding.

The outer ferrule 146 is configured to be crimped to the cable 106. The outer ferrule 146 provides strain relief for the cable 106. In an exemplary embodiment, the outer ferrule 146 is configured to be crimped to the cable braid 134 and the cable jacket 136. For example, the outer ferrule 146 may be crimped to the cable braid 134 and the cable jacket 136 using an F-crimp or another type of crimp. Because the outer contact 144 is stamped and formed, the outer contact 144 tends to be a thinner metal than a die-cast or screw machined part, and the crimp of the outer ferrule 146 should be performed in a manner that does not crush the outer contact 144 and the center conductor 130.

The cavity insert 148 surrounds at least a portion of the outer contact 144 and is axially secured with respect to the outer contact 144 to hold the outer contact 144 therein. The cavity insert 148 is received within the outer housing 152 and is held therein by a lock 154. The cavity insert 148 is used to hold the true position of the outer contact 144 within the outer housing 152. The cavity insert 148 has a predetermined outer perimeter that corresponds with the outer housing 152 such that the cavity insert 148 is configured to be secured within the outer housing 152. Optionally, different cavity inserts 148 having different internal diameters and features may be provided to receive different sized outer contacts 144 therein and to hold the different sized outer contacts 144 within the outer housing 152. Optionally, a family of jack assemblies may be provided, with some of the jack assemblies having die-cast or screw machined outer contacts that are configured to be held in a particular outer housing 152. The cavity insert 148 is dimensioned the same as the die-cast or screw machined outer contacts such that the cavity insert 148 and stamped and formed outer contact 144 may be used within the same outer housing 152 as the die-cast or screw machined outer contacts, thus reducing the part count of the product family.

The cable insert 150 is positioned rearward of the cavity insert 148 and surrounds a portion of the cable 106 and/or portions of the outer contact 144 and outer ferrule 146. The cable insert 150 is used to hold a true position of the outer contact 144 and cable 106 in the outer housing 152.

The center contact 140, dielectric 142, outer contact 144, outer ferrule 146, cavity insert 148 and optionally the cable insert 150 define a jack subassembly 156 that is configured to be loaded into the outer housing 152 as a unit. The outer housing 152 includes a cavity 158 that receives the jack subassembly 156. The lock 154 holds jack subassembly 156 in the cavity 158.

Figure 3:
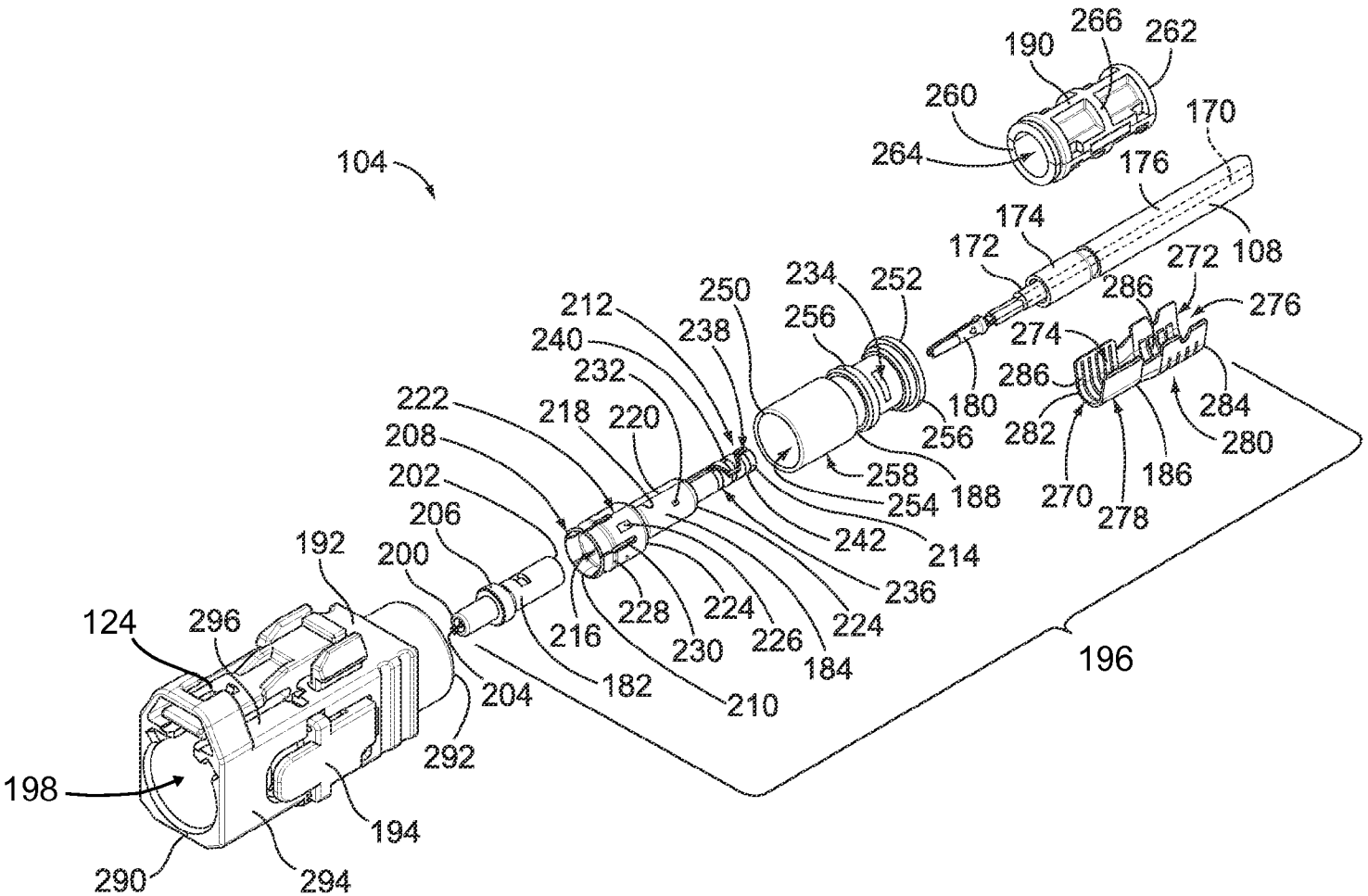
FIG. 3 is an exploded view of the plug assembly shown in FIG. 1.

FIG. 3 is an exploded view of the plug assembly 104 and the cable 108. The cable 108 is a coaxial cable having a center conductor 170 surrounded by a dielectric 172. A cable braid 174 surrounds the dielectric 172. The cable braid 174 provides shielding for the center conductor 170 along the length of the cable 108. A cable jacket 176 surrounds the cable braid 174.

The plug assembly 104 includes a center contact 180, a dielectric 182, an outer contact 184, an outer ferrule 186, a cavity insert 188, an optional cable insert 190 and an outer housing 192. In the illustrated embodiment, the center contact 180 constitutes a socket contact, however other types of contacts are possible in alternative embodiments. The center contact 180 is terminated to the center conductor 170 of the cable 108. For example, the center contact 180 may be crimped to the center conductor 170.

The dielectric 182 receives and holds the center contact 180 and possibly a portion of the center conductor 170. The outer contact 184 receives the dielectric 182 therein. The outer contact 184 surrounds the dielectric 182 and at least a portion of the center contact 180. The outer contact 184 provides shielding for the center contact 180, such as from electromagnetic or radio frequency interference. In an exemplary embodiment, the outer contact 184 is stamped and formed, which makes the outer contact 184 less expensive than manufacturing the outer contact by other methods, such as die-casting or screw machining. The dielectric 182 electrically isolates the center contact 180 from the outer contact 184. The outer contact 184 is configured to be electrically connected to the cable braid 174.

The outer ferrule 186 is configured to be crimped to the cable 108. The outer ferrule 186 provides strain relief for the cable 108. In an exemplary embodiment, the outer ferrule 186 is configured to be crimped to the cable braid 174 and the cable jacket 176. For example, the outer ferrule 186 may be crimped to the cable braid 174 and the cable jacket 186 using an F-crimp or another type of crimp. Because the outer contact 184 is stamped and formed, the outer contact 184 tends to be a thinner metal than a die-cast or screw machined part, and the crimp of the outer ferrule 186 should be performed in a manner that does not crush the outer contact 184 and the center conductor 170.

The cavity insert 188 surrounds at least a portion of the outer contact 184 and is axially secured with respect to the outer contact 184 to hold the outer contact 184 therein. The cavity insert 188 is received within the outer housing 192 and is held therein by a lock 194. The cavity insert 188 is used to hold the true position of the outer contact 184 within the outer housing 192. The cavity insert 188 has a predetermined outer perimeter that corresponds with the outer housing 192 such that the cavity insert 188 is configured to be secured within the outer housing 192. Optionally, different cavity inserts 188 having different internal diameters and features may be provided to receive different sized outer contacts 184 therein and to hold the different sized outer contacts 184 within the outer housing 192. Optionally, different types of jack assemblies may be provided and offered to customers as a family, with some of the jack assemblies having die-cast or screw machined outer contacts that are configured to be held in a particular outer housing 192. The cavity insert 188 is dimensioned the same as the die-cast or screw machined outer contacts such that the cavity insert 188 and stamped and formed outer contact 184 may be used within the same outer housing 192 as the die-cast or screw machined outer contacts, thus reducing the part count of the product family.

The cable insert 190 is positioned rearward of the cavity insert 188 and surrounds a portion of the cable 108 and/or portions of the outer contact 184 and outer ferrule 186. The cable insert 190 is used to hold a true position of the outer contact 184 and cable 108 in the outer housing 192.

The center contact 180, dielectric 182, outer contact 184, outer ferrule 186, cavity insert 188 and optionally the cable insert 190 define a plug subassembly 196 that is configured to be loaded into the outer housing 192 as a unit. Other components may also be part of the plug subassembly 196. The outer housing 192 includes a cavity 198 that receives the plug subassembly 196. The lock 194 holds plug subassembly 196 in the cavity 198.

The dielectric 182 extends between a front 200 and a rear 202. The dielectric 182 has a cavity 204 that receives the center contact 180. The dielectric 182 includes a flange 206 that extends radially outward therefrom. Optionally, the flange 206 may be approximately centrally located between the front 200 and the rear 202. The flange 206 is used to position the dielectric 182 within the outer contact 184.

The outer contact 184 has a mating end 208 at a front 210 thereof and a cable end 212 at a rear 214 thereof. The outer contact 184 has a cavity 216 extending between the front 210 and the rear 214. In an exemplary embodiment, the outer contact 184 is stamped and formed from a flat workpiece that is rolled into a barrel shape. The barrel shape may be stepped. The barrel shape may be generally cylindrical or cylindrical along different portions. The flat workpiece has a first end 218 and a second end 220 that are rolled toward one another into the barrel shape until the first and second ends 218, 220 oppose one another. A seam 222 is created at the interface between the first and second ends 218, 220. The first and second ends 218, 220 may touch one another at the interface of the seam 222. Optionally, the first and second ends 218, 220 may be secured together at the seam 222 to hold the barrel shape.

The barrel shape is stepped along the length of the outer contact 184 to define shoulders 224. When the dielectric 182 is loaded into the cavity 216, the flange 206 engages the shoulder 224 to axially position the dielectric 182 with respect to the outer contact 184. In an exemplary embodiment, the outer contact 184 may include one or more retention tabs 226 that extend into the cavity 216 to engage the dielectric 182 to hold the dielectric 182 in the outer contact 184. For example, the rear facing surface of the flange 206 may engage the shoulder 224, while the retention tab 226 may engage the front facing surface of the flange 206 such that the flange 206 is captured between the shoulder 224 and the retention tab 226 to hold the axial position of the dielectric 182 within the outer contact 184. Other types of securing or positioning elements may be used in alternative embodiments for positioning or securing the dielectric 182 in the outer contact 184.

The outer contact 184 has a plurality of contact beams 228 at the mating end 208. The contact beams 228 are deflectable and are configured to be spring loaded against the outer contact 144 (shown in FIG. 2) of the jack assembly 102 (shown in FIG. 2). The contact beams 228 are profiled to have an area of reduced diameter at the mating end 208 to ensure that the contact beams 228 engage the outer contact 144 of the jack assembly 102. Each of the individual contact beams 228 are separately deflectable and exert a normal force on the outer contact 144 to ensure engagement of the outer contact 184 and the outer contact 144. The contact beams 228 are separated by slots 230 extending between the contact beams 228. The slots 230 extend rearward from the front 210 of the outer contact 184.

The outer contact 184 includes a positioning tab 232 extending radially outward therefrom. The positioning tab 232 is configured to engage the cavity insert 188 to axially position the outer contact 184 with respect to the cavity insert 188. The cavity insert 188 includes a channel 234 that receives the positioning tab 232. Optionally, the channel 234 may be elongated such that the outer contact 184 may be rotated within the cavity insert 188. Other types of securing or positioning elements may be used in alternative embodiments for positioning or securing the outer contact 184 in the cavity insert 188.

The outer contact 184 has an inner ferrule segment 236 at the cable end 212. The cable braid 174 is configured to be terminated to the inner ferrule segment 236, as described in further detail below. In an exemplary embodiment, a gap 238 is defined along the seam 222 between the first and second ends 218, 220 of the inner ferrule segment 236. The size of the gap 238 is variable to change a diameter of the inner ferrule segment 236. For example, the gap 238 may be closed to decrease the diameter of the inner ferrule segment 236. The gap 238 extends generally axially along the inner ferrule segment 236 at the seam 222. In an exemplary embodiment, the gap 238 extends along a tortuous path defined by fingers 240 extending from the first end 218 and fingers 242 extending from the second end 220. The fingers 240, 242 are interdigitated with the gap 238 therebetween. Optionally, more than one gap may be provided along the inner ferrule segment 236.

Changing the size of the gap 238 changes the radius of the outer conductor surrounding the center conductor 170 and/or center contact 180, thereby controlling the capacitance between inner and outer conductors, and controlling the impedance. The size of the gap 238 (e.g., the distance between the first end 218 and the second end 220 along the inner ferrule segment 236) defines the amount of air exposure and thus changes the effective dielectric constant between the inner and outer conductors. By controlling the size of the gap 238, the impedance may be controlled along the path of the center conductor 170 and/or center contact 180 extending through the inner ferrule segment 236. For example, by reducing the size of the gap 238 (e.g., by squeezing the inner ferrule segment 236 to position the first end 218 closer to the second end 220) the impedance may be decreased. A target impedance, such as 50 ohms, may be achieved by controlling the size of the gap 238.

As explained in further detail below, the size of the gap 238 may be controlled by the outer ferrule 186. For example, by crimping the outer ferrule 186 around the inner ferrule segment 236, the inner ferrule segment 236 may be squeezed to close the gap 238. Additionally, by closing the gap 238 the diameter of the inner ferrule segment 236 is decreased. By decreasing the diameter of the inner ferrule segment 236, the inner surface of the inner ferrule segment 236 is positioned relatively closer to the center conductor 170 and/or the center contact 180, which will also affect the impedance.

In an alternative embodiment, rather than being stamped and formed, the outer contact 184 may be made by another manufacturing method and provided with a seam, at least along the inner ferrule segment, such that the diameter of the inner ferrule segment may be changed. For example, the outer contact 184 may be die-cast, extruded, screw machined, and the like, and then provided with a seam and gap along the inner ferrule segment. The outer ferrule 186 can then be used to change the diameter of the inner ferrule segment and thus control the impedance.

The cavity insert 188 includes a front 250 and a rear 252. The cavity insert 188 has a cavity 254 extending between the front 250 and the rear 252. The cavity insert 188 includes flanges 256 that extend circumferentially around the cavity insert 188. The flanges 256 are configured to be received within the outer housing 192 to engage surfaces in the outer housing 192 to hold the axial position of the cavity insert 188 with respect to the outer housing 192. The lock 194 engages the flange 256 to hold the cavity insert 188 in the cavity 198 of the outer housing 192.

The cavity insert 188 includes a sleeve 258 at the front 250. The sleeve 258 circumferentially surrounds the front 210 of the outer contact 184. The sleeve 258 is positioned radially outward of the contact beams 228 and protects the contact beams 228, such as during loading of the jack subassembly 156 into the outer housing 192 and/or during mating of the plug assembly 104 with the jack assembly 102.

The cable insert 190 is optionally used with the plug assembly 104. The cable insert 190 includes a front 260 and a rear 262 the cable insert 190 includes a cavity 264 extending between the front 260 and the rear 262. Optionally, the cable insert 190 may have a split design with two halves that are coupled around the cable 108. The cable insert 190 includes a plurality of ribs 266 that extend longitudinally or circumferentially. The ribs 266 define surfaces that are configured to engage corresponding surfaces of the outer housing 192 to hold the axial and/or rotational position of the cable insert 190 within the outer housing 192. When assembled, the cable insert 190 may surround the outer ferrule 186.

The outer ferrule 186 is stamped and formed from a flat workpiece having a first end 270 and a second end 272. The outer ferrule 186 is formed into an open barrel shape, such as a U-shape that has an open top 274. The outer ferrule 186 defines a channel 276. The cable 108 may be received in channel 276 and then the outer ferrule 186 may be crimped to the cable 108.

The outer ferrule 186 includes a braid segment 278 and a jacket segment 280. The braid segment 278 is provided at a front 282 of the outer ferrule 186 and the jacket segment 280 is provided at a rear 284 of the outer ferrule 186. The braid segment 278 is configured to be crimped around the inner ferrule segment 236 and the cable braid 174. The jacket segment 280 is configured to be crimped around the cable jacket 176. The outer ferrule 186 may include notches or serrations 286 that define surfaces that engage the cable braid 174 and/or cable jacket 176 to help hold the axial position of the outer ferrule 186 with respect to the cable 108. The outer ferrule 186 provides strain relief for the cable 108.

As described in further detail below, crimping the braid segment 278 may affect the size of the gap 238. Crimping the braid segment 278 may close the inner ferrule segment 236. The crimp height of the braid segment 278 may be controlled to control the amount of closure of the gap 238.

The outer housing 192 extends between a front 290 and a rear 292. The lock 194 is loaded through a side 294 of the outer housing 192. The latching feature 124 is provided along a top 296 of the outer housing 192. The outer housing 192 has a generally boxed shape outer profile. The cavity 198 is generally a cylindrical bore extending through the outer housing 192. The cavity 198 may have steps, shoulders and/or channels formed therein for receiving and holding the cavity insert 188 and/or the cable insert 190.

Figure 4:
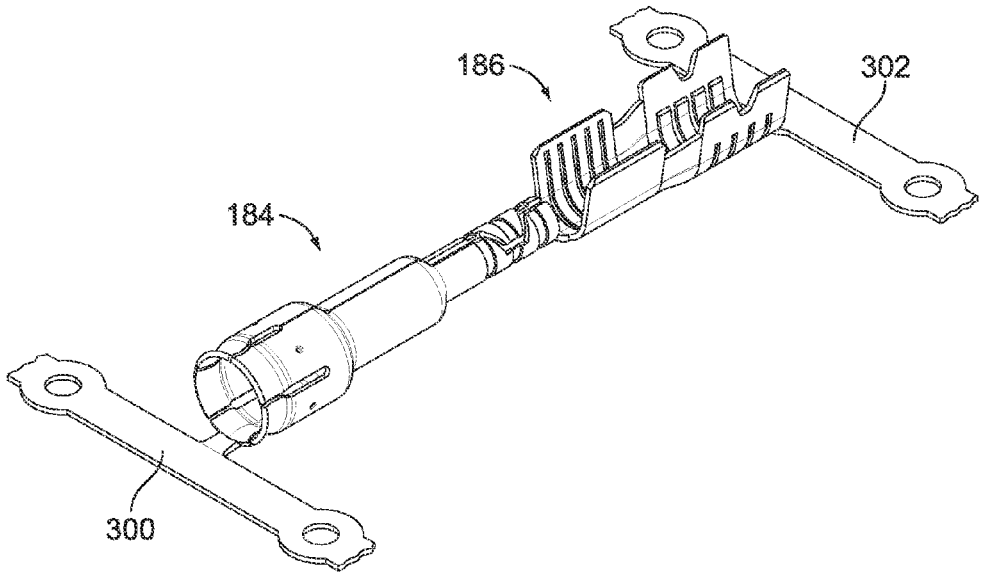
FIG. 4 is a perspective view of a portion of the plug assembly shown in FIG. 3.

FIG. 4 is a perspective view of the outer contact 184 and the outer ferrule 186 on a carrier strip. The outer contact 184 and the outer ferrule 186 are stamped and formed components. In an exemplary embodiment, the outer contact 184 and outer ferrule 186 may be stamped from the same workpiece, formed and then separated from one another. The outer contact 184 is connected to a carrier 300 while the outer ferrule 186 is connected to a carrier 302 such that the outer contacts 184 and the outer ferrules 186 may be handled separately once separated, such as by winding many outer contacts 184 onto a reel and winding many outer ferrules 186 onto a reel such that the outer contacts 184 and the outer ferrules 186 may be fed into an assembly machine separate from one another. In an alternative embodiment, rather than having the outer contacts 184 and outer ferrules 186 formed from the same workpiece, the outer contacts 184 may be stamped and formed separately from the outer ferrules 186.

Figure 5:
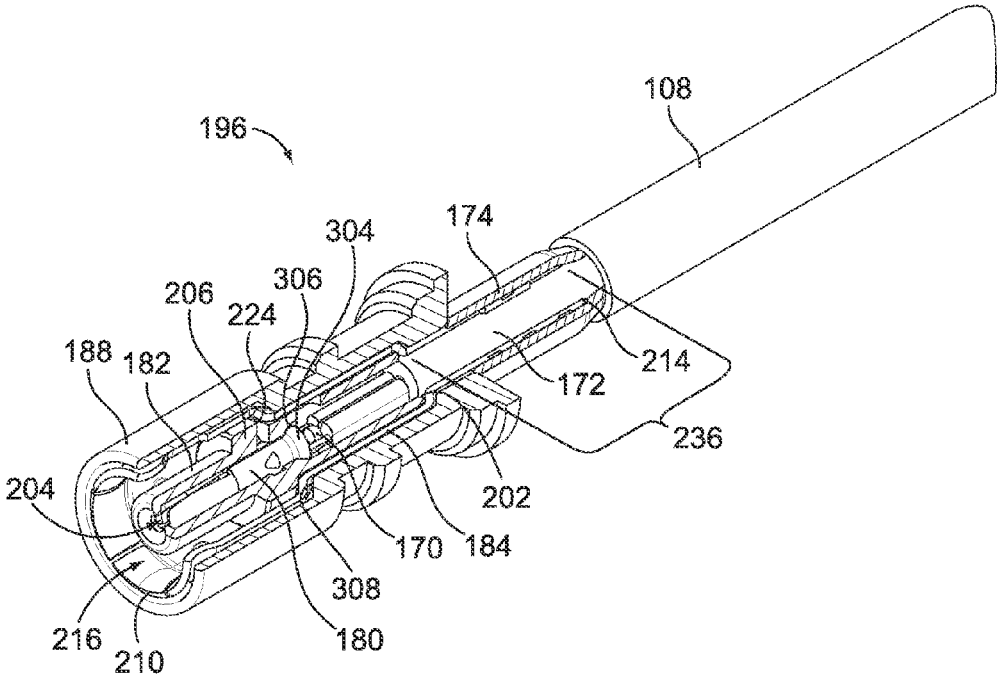
FIG. 5 is a partial sectional view of the plug assembly.

FIG. 5 is a partial sectional view of the plug subassembly 196 without the cable insert 190 (shown in FIG. 3) and without the outer ferrule 186 (shown in FIG. 3). During assembly, the center contact 180 is terminated to the center conductor 170.

During assembly, the dielectric 182 is loaded into the outer contact 184 through the front 210 of the outer contact 184. The dielectric 182 is pushed into the cavity 216 until the flange 206 engages the shoulder 224. The retention tabs 226 (shown in FIG. 3) snap into place in front of the flange 206 to hold the dielectric 182 in the outer contact 184.

The cavity insert 188 is loaded onto the outer contact 184. The cavity insert 188 is loaded over the rear 214 until an inner ring 308 of the cavity insert 188 engages the shoulder 224. The interference between the inner ring 308 and the shoulder 224 holds the axial position of the cavity insert 188 with respect to the outer contact 184.

Once the cavity insert 188 is positioned over the outer contact 184, the center contact 180 is loaded into the dielectric 182. The cable 108 and center contact 180 are loaded through the rear 214 of the outer contact 184 and into the dielectric 182. The center contact 180 is loaded into the dielectric 182 through the rear 202. A flange 304, on the center contact 180, engages a shoulder 306 in the cavity 204 of the dielectric 182 to axially position the center contact 180 within the dielectric 182. As the cable 108 is coupled to the outer contact 184, the cable dielectric 172 is received in the inner ferrule segment 236 of the outer contact 184. The cable braid 174 is placed along the outside of the inner ferrule segment 236.

Figure 6:
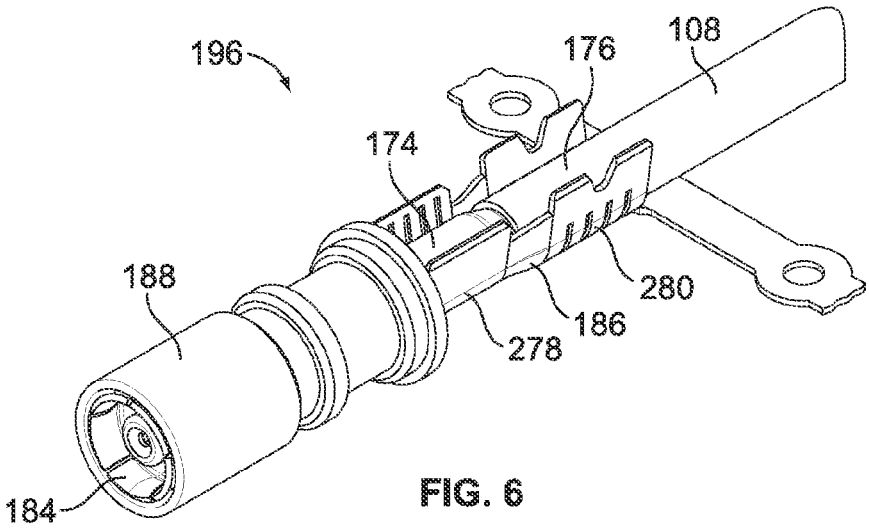
FIG. 6 is a perspective view of a portion of the plug assembly.

FIG. 6 is a perspective view of the plug subassembly 196 showing the outer ferrule 186 positioned around the cable 108 for crimping. The outer ferrule 186 is positioned behind the cavity insert 188. The braid segment 278 is aligned with the cable braid 174 and the jacket segment 280 is aligned with the cable jacket 176. Optionally, the outer ferrule 186 may be positioned immediately behind the cavity insert 188 such that the outer ferrule 186 holds the cavity insert 188 from sliding rearward with respect to the outer contact 184.

Figure 7:
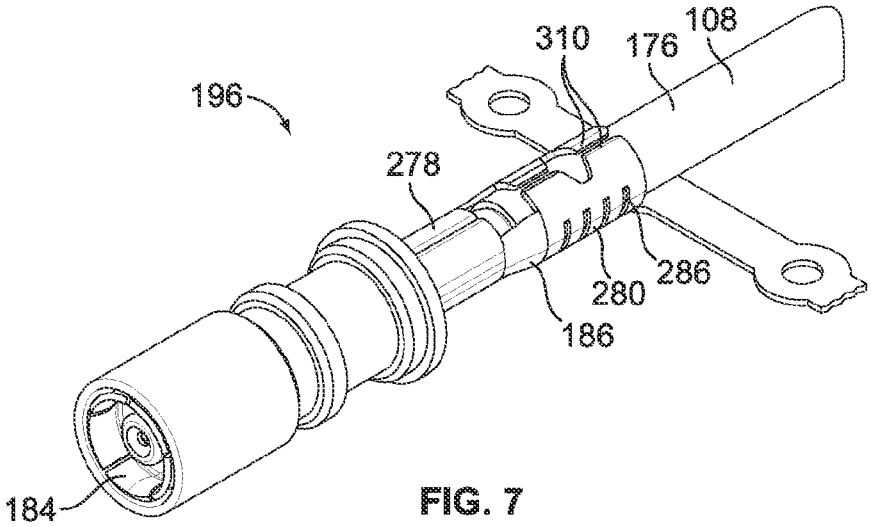
FIG. 7 is a perspective view of a portion of the plug assembly.
Figure 8:
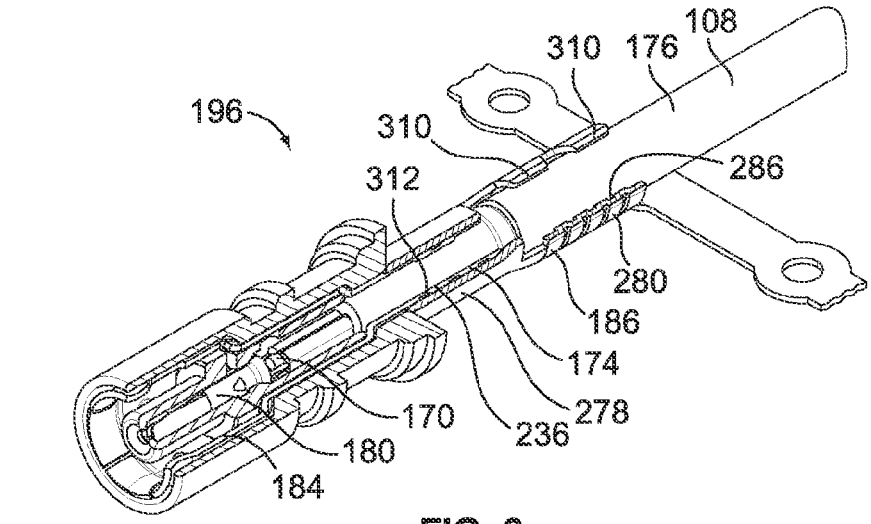
FIG. 8 is a partial sectional view of the portion of the plug assembly shown in FIG. 7.

FIG. 7 is a perspective view of the plug subassembly 196 with the outer ferrule 186 crimped to the cable 108. FIG. 8 is a partial sectional view of the plug subassembly 196 shown in FIG. 7. The jacket segment 280 is crimped to secure the outer ferrule 186 to the cable jacket 176. Tabs 310 of the jacket segment 280 dig into the cable jacket 176. The serrations 286 also engage the cable jacket 176 to hold the cable 108 in the outer ferrule 186. In an exemplary embodiment, the serrations 286 on the jacket segment 280 are reverse serrations, which are formed by pressing the serrations inward such that the serrations 286 dig into the jacket 176 and hold the axial position of the outer ferrule 186 on the jacket. In contrast, the serrations 286 on the braid segment 278 extend in the opposite direction, such as by pressing the serrations outward to define channels or notches that receive the cable braid 174 therein.

The braid segment 278 is crimped to the cable braid 174 (shown in FIG. 8). The cable braid 174 is positioned between the braid segment 278 and the inner ferrule segment 236 (shown in FIG. 8) of the outer contact 184. Crimping the braid segment 278 presses the cable braid 174 against the inner ferrule segment 236 to ensure electrical contact between the outer contact 184 and the cable braid 174. A continuous electrical path is thus defined between the outer contact 184 and the cable braid 174. The cable braid 174 provides circumferential shielding around the center conductor 170 (shown in FIG. 8) while the outer contact 184 provides circumferential shielding around the center contact 180 (shown in FIG. 8). The serrations 286 (shown in FIG. 3) on the braid segment 278 create friction between the outer ferrule 186 and the cable braid 174. In an exemplary embodiment, the inner ferrule segment 236 includes serrations 312 (shown in FIG. 8) along the outer surface thereof that create friction between the cable braid 174 and the outer contact 184. The braid segment 278 presses the cable braid 174 against the inner ferrule segment 236 and into the notches defined by the serrations 312.

In an exemplary embodiment, as described above, the inner ferrule segment 236 includes a gap 238 (shown in FIG. 3) along the seam 222 (shown in FIG. 3). The size of the gap 238 is variable to control an impedance along the transmission path in the inner ferrule segment 236. For example, by controlling the size of the gap 238, an amount of air surrounding the cable 108 may be controlled. Additionally, by squeezing the inner ferrule segment, and thus closing the gap 238, the diameter of the inner ferrule segment 236 may be reduced forcing the inner ferrule segment 236 closer to the center conductor 170. The amount of air in the gap 238 and/or the relative distance between the inner ferrule segment 236 and the center conductor 170 affect the impedance of the transmission path. A tighter crimp on the braid segment 278 may squeeze the inner ferrule segment 236 by a greater amount, thus closing the gap 238 by a greater amount. As such, by controlling a crimp height of the crimp of the braid segment 278, the amount of closing of the inner ferrule segment 236 and thus the size of the gap 238 may be precisely controlled. By controlling the size of the gap 238 and the diameter of the inner ferrule segment 236, a target impedance may be achieved, such as 50 ohms.

Figure 9:
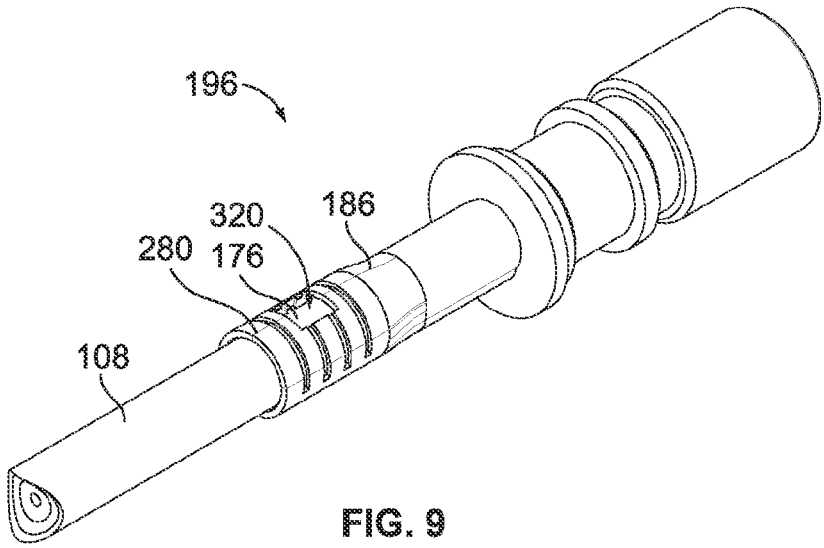
FIG. 9 is a rear perspective view of a portion of the plug assembly.

FIG. 9 is a rear perspective view of the plug subassembly 196 showing a bottom of the outer ferrule 186. The outer ferrule 186 includes a hole 320 extending therethrough. During crimping of the jacket segment 280, a portion of the cable jacket 176 may be extruded into and/or through the hole 320. Having the cable jacket 176 extending into the hole 320 creates an interference between the outer ferrule 186 and the cable jacket 176, which helps to secure the cable 108 with the outer ferrule 186.

Figure 10:
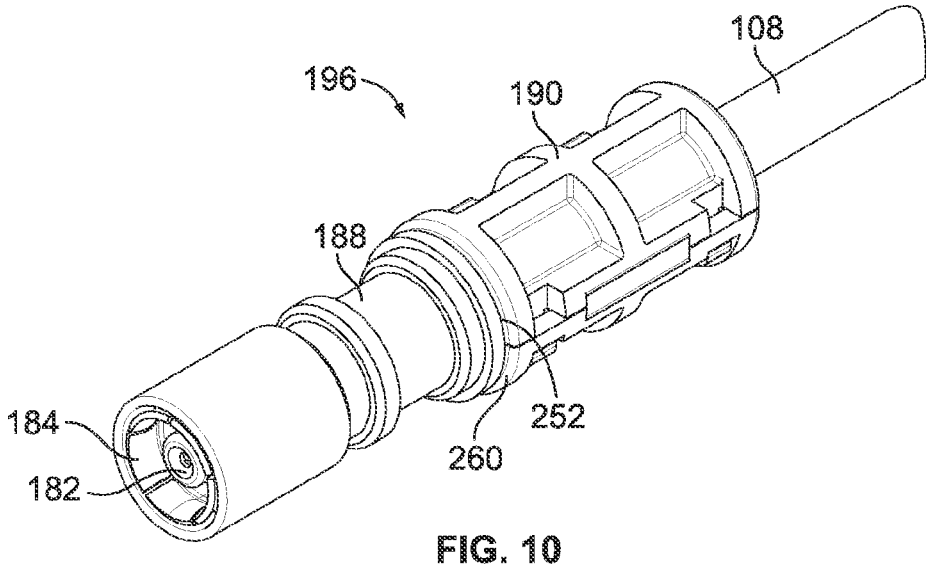
FIG. 10 is a front perspective view of a portion of the plug assembly.

FIG. 10 is a front perspective view of the plug subassembly 196 showing the cable inserts 190 attached over the outer ferrule 186 (shown in FIG. 9) and the cable 108. The cable insert 190 may be an optional feature. In the illustrated embodiment, the cable insert 190 is positioned immediately behind the cavity insert 188. The front 260 engages the rear 252 of the cavity insert 188. The two halves of the cable insert 190 are coupled together, such as using latches. Optionally, the cable 108 and the cavity insert 188 may be rotatable with respect to the cable insert 190. As such, when the cable insert 190 is rigidly held within the outer housing 192 (shown in FIG. 3) (e.g., axially and rotatably held within the outer housing 192) the other portions of the plug subassembly 196, such as the center contact 180 (shown in FIG. 3), dielectric 182, outer contact 184, outer ferrule 186 (shown in FIG. 3) and cavity insert 188 may be rotated with the cable 108 with respect to the outer housing 192 and cable insert 190. Such rotation allows for positioning of the outer housing 192 for mating with the jack assembly 102 (shown in FIG. 2). In an alternative embodiment, the cable insert 190 is placed against the coaxial cable 108 and is configured to rotate inside the outer housing 192 with the plug subassembly 196. The cavity insert 188 and cable insert 190 hold the axial position of the plug subassembly 196.

Figure 11:
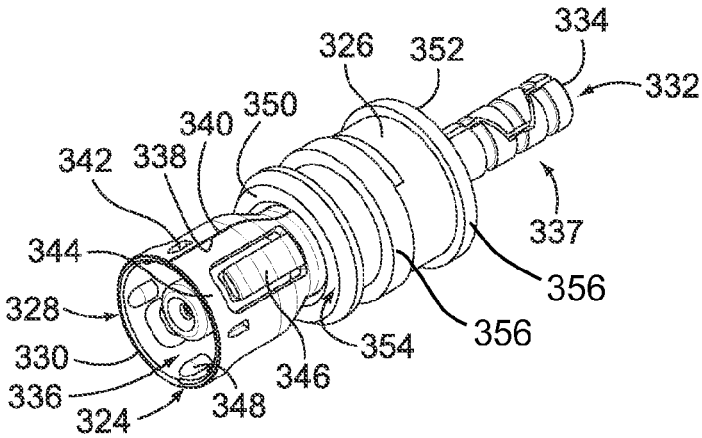
FIG. 11 is a front perspective view of an alternative outer contact and an alternative cavity insert for the plug assembly.

FIG. 11 is a front perspective view of an alternative outer contact 324 and an alternative cavity insert 326. The outer contact 324 differs from the outer contact 184 (shown in FIG. 3) in that the outer contact 324 has a different mating interface. The outer contact 324 has a mating end 328 at a front 330 and a cable end 332 at a rear 334 of the outer contact 324. A cavity 336 extends between the front 330 and the rear 334. The outer contact 324 has an inner ferrule portion 337 at the cable end 332. The outer contact 324 is stamped and formed from a flat workpiece which is rolled into a barrel shape. The workpiece has a first end 338 and a second end 340 that are rolled into the barrel shape to oppose one another and meet at a seam 342. The mating end 328 has a ring 344 at the front 330 of the outer contact 324. The mating end 328 has a plurality of contact beams 346 rearward of the ring 344. The mating end 328 has a plurality of protrusions 348 extending radially inward therefrom. The protrusions 348 are positioned between the contact beams 346. The contact beams 346 and the protrusions 348 are configured to engage the outer contact 144 (shown in FIG. 2) of the jack assembly 102 (shown in FIG. 2). In the illustrated embodiment, four contact beams 346 and four protrusions 348 are provided, defining eight points of contact with the outer contact 144. The ring 344 is positioned forward of the contact beams 344 to protect the contacts beams 346 from damage during loading of the outer contacts 324 into the outer housing 192 and/or during mating with the jack assembly 102. As such, the cavity insert 326 does not need to extend over and protect the contact beams 346.

The cavity insert 326 is shorter than the cavity insert 188 (shown in FIG. 3) and only extends over a middle portion of the outer contact 324. The mating end 328 of the outer contact 324 extends forward of the cavity insert 326. The cavity insert 326 includes a front 350 and a rear 352. The cavity insert 326 has a cavity 354 extending between the front and the rear 350, 352. The cavity insert 326 includes flanges 356 extending radially outward therefrom. The flanges 356 are configured to engage corresponding surfaces in the outer housing 192 (shown in FIG. 3) when loaded therein. The flanges 356 also provide surfaces for engaging the lock 194 (shown in FIG. 3) to secure the cavity insert 326 within the outer housing 192.

Figure 12:
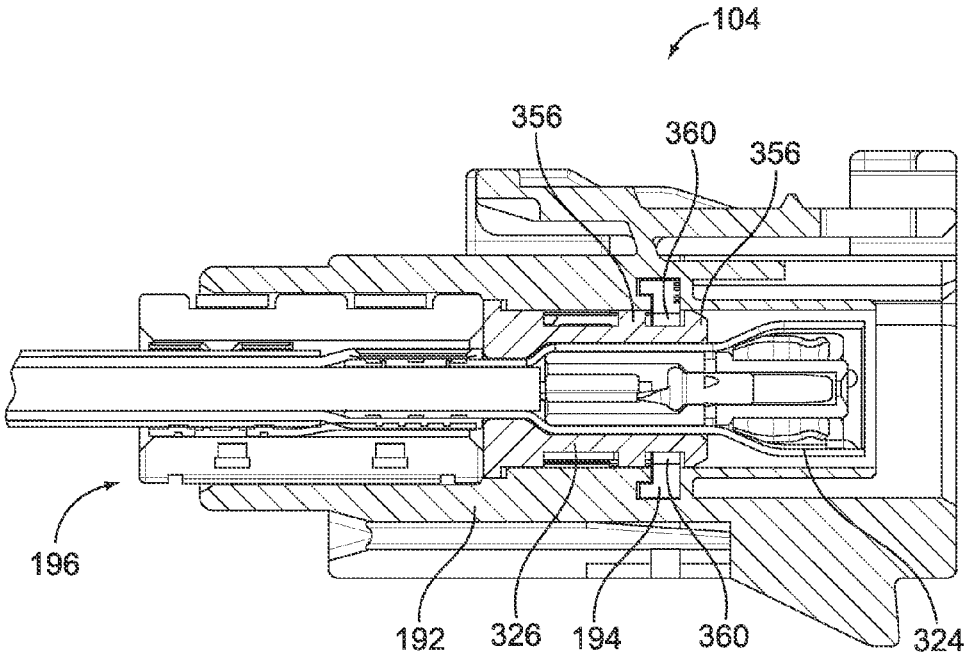
FIGS. 12 and 13 are cross sectional views of the plug assembly shown in FIG. 11.
Figure 13:
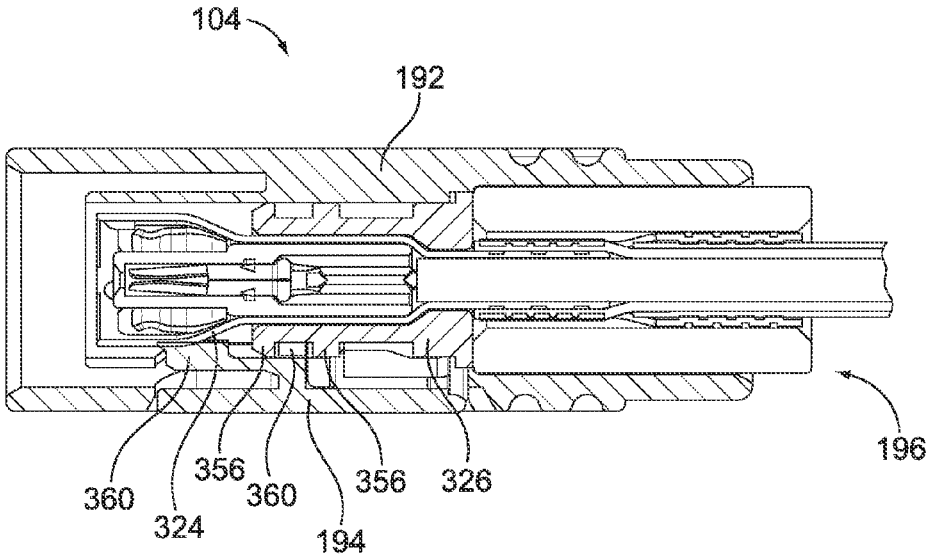

FIGS. 12 and 13 are cross sectional views taken vertically and horizontally, respectively, through the plug assembly 104. FIGS. 12 and 13 show the plug subassembly 196 using the outer contact 324 and cavity insert 326. FIGS. 12 and 13 show the plug subassembly 196 loaded into the outer housing 192. When the plug subassembly 196 is loaded into the outer housing 192, the lock 194 secures the plug subassembly 196 within the outer housing 192. The lock 194 includes fingers 360 that engage the flanges 356 and/or other portions of the cavity insert 326 and/or outer contact 324 to hold the cavity insert 326 axially within the outer housing 192.

Figure 14:
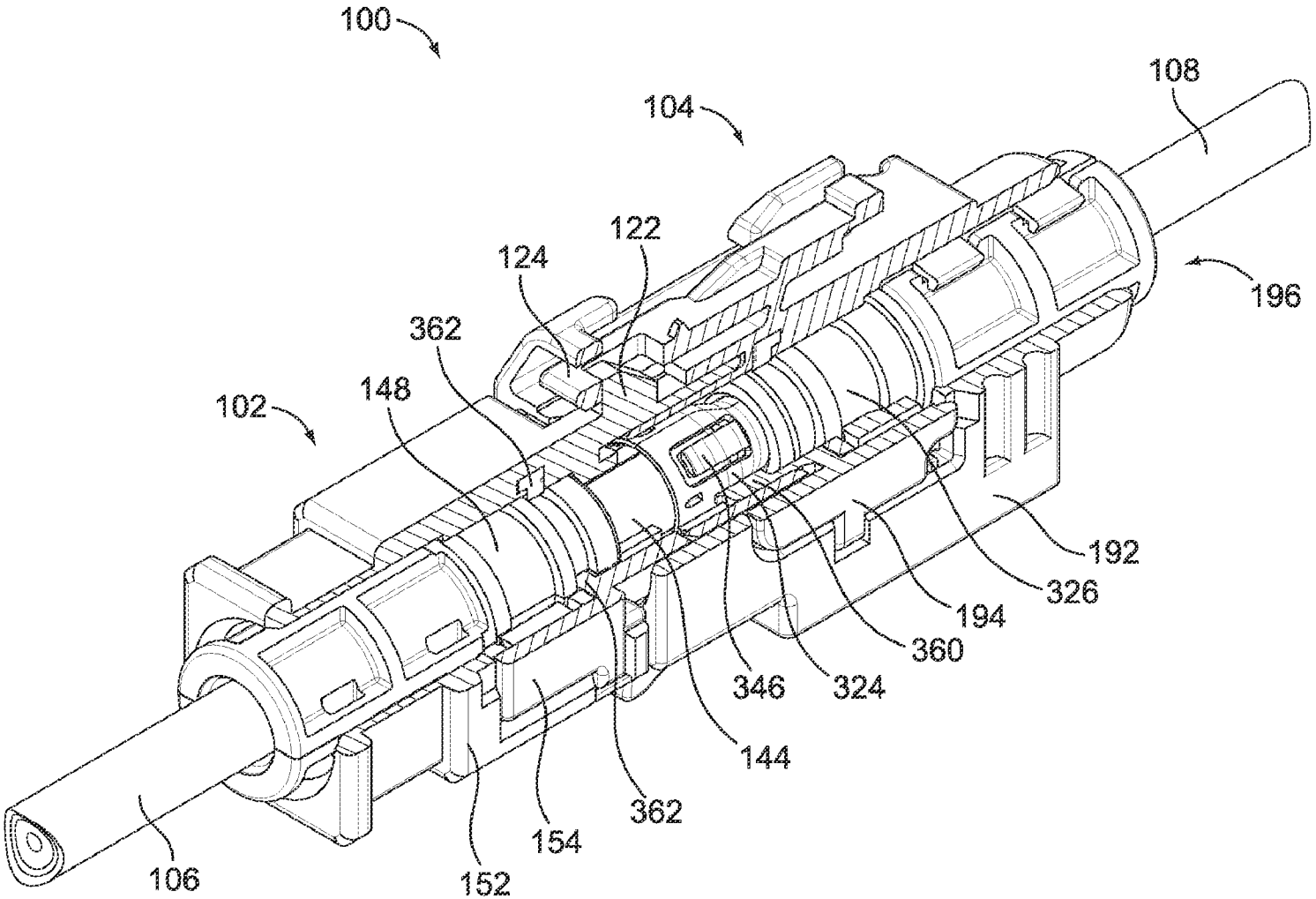
FIG. 14 is a partial sectional view of the connector system shown in FIG. 1.

FIG. 14 is a partial sectional view of the connector system 100 showing the jack assembly 102 mated with the plug assembly 104. FIG. 14 shows the plug assembly 104 with the plug subassembly 196 using the outer contact 324 and the cavity insert 326. The contact beams 346 engage the outer contact 144 of the jack assembly 102 to electrically connect the outer contact 144 with the outer contact 324. The outer contacts 144, 324 are electrically connected to the corresponding cable braids 134, 174 (shown in FIGS. 2 and 3, respectively) of the cables 106, 108 to create a continuous shield along the transmission path between the center conductor 130 (shown in FIG. 2) and the center conductor 170 (shown in FIG. 3). FIG. 14 also illustrates the fingers 360 of the lock 194 engaging the cavity insert 326 to position the plug subassembly 196 within the outer housing 192. Similarly, the lock 154 of the jack assembly 102 includes fingers 362 that engage the cavity insert 148 of the jack assembly 102 to position the cavity insert 148 within the outer housing 152. The latching feature 122 engages the latching feature 124 to secure the jack assembly 102 to the plug assembly 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a center contact configured to be terminated to a center conductor of a cable;

a dielectric holding the center contact;

a stamped and formed outer contact surrounding the dielectric and the center contact, the outer contact being formed from a flat workpiece having a first end and a second end, the outer contact being formed into a barrel shape such that the first end opposes the second end at a seam extending along an entire length of the outer contact, the outer contact being configured to be terminated to a braid of the cable; and a stamped and formed outer ferrule surrounding at least a portion of the outer contact such that the braid is sandwiched between the outer ferrule and the outer contact, the outer ferrule being formed from a flat workpiece having a first end and a second end, the outer ferrule being crimped around the cable and the outer contact such that the first end opposes the second end.

2. The connector assembly of claim 1, wherein the outer contact includes a plurality of contact beams that are deflectable and are configured to be spring loaded against an outer contact of a mating connector assembly.

3. The connector assembly of claim 1, wherein the outer contact is rolled into a stepped barrel shape having at least one shoulder, the dielectric engaging the shoulder to axially position the dielectric with respect to the outer contact, the outer contact having a retention tab engaging the dielectric to hold the dielectric within the outer contact.

4. The connector assembly of claim 1, wherein the outer contact has an inner ferrule segment with a gap being defined between the first and second ends along the inner ferrule segment, the size of the gap being controllable to control an impedance of the outer contact and the center contact.

5. The connector assembly of claim 4, wherein the outer ferrule surrounds the inner ferrule segment, the outer ferrule being crimped to control the size of the gap in the inner ferrule segment.

6. The connector assembly of claim 1, wherein the outer contact includes a mating end and a cable end, the cable end being terminated to the braid, the mating end having a ring at a front of the outer contact, the mating end having a plurality of contact beams rearward of the ring, the mating end having protrusions extending radially inward therefrom, the protrusions being positioned between the contact beams, the contact beams and the protrusions being configured to engage an outer contact of a mating connector assembly.

7. The connector assembly of claim I, wherein the outer ferrule includes a braid segment and jacket segment, the braid segment being configured to be crimped around the outer contact and the braid, the jacket segment being configured to be crimped around a jacket of the cable.

8. The connector assembly of claim 1, wherein the outer ferrule provides strain relief for the connection between both the center contact and the outer contact and the cable.

9. The connector assembly of claim 1, further comprising a cavity insert surrounding the outer contact, the cavity insert being axially secured with respect to the outer contact to hold the outer contact therein, the cavity insert having a flange, the center contact, dielectric, outer contact, outer ferrule and cavity insert defining a subassembly; and an outer housing having a cavity receiving the subassembly, the flange being locked into the outer housing to hold the axial position of the subassembly within the cavity.

10. A connector assembly comprising:

a center contact configured to be terminated to a center conductor of a cable;

a dielectric holding the center contact;

an outer contact surrounding the dielectric and the center contact, the outer contact being configured to be terminated to a braid of the cable, the outer contact including a plurality of contact beams that are deflectable and configured to be spring loaded against an outer contact of a mating connector assembly;

a cavity insert surrounding the outer contact, the cavity insert extending over and being positioned radially outward of the contact beams, the cavity insert being axially secured with respect to the outer contact to hold the outer contact therein, the cavity insert having a flange, the center contact, dielectric, outer contact and cavity insert defining a subassembly; and an outer housing having a cavity receiving the subassembly, the flange being locked into the outer housing to hold the axial position of the subassembly within the cavity.

11. The connector assembly of claim 10, wherein the outer contact includes a securing feature and the cavity insert includes a securing feature engaging the securing feature of the outer contact to hold the axial position of the outer contact with respect to the cavity insert.

12. The connector assembly of claim 10, wherein the subassembly is rotatable 360° within the outer housing.

13. The connector assembly of claim 10, wherein the cavity insert includes a sleeve at a front of the cavity insert, the sleeve surrounding a front of the outer contact

14. The connector assembly of claim 10, further comprising an outer ferrule surrounding at least a portion of the outer contact such that the braid is sandwiched between the outer ferrule and the outer contact.

15. The connector assembly of claim 10, wherein the outer contact is formed from a flat workpiece having a first end and a second end, the outer contact being formed into a barrel shape such that the first end opposes the second end at a seam, the outer contact having an inner ferrule segment with a gap being defined between the first and second end at the seam along the inner ferrule segment, the size of the gap being controllable to control an impedance of the outer contact and the center contact.

16. A connector assembly comprising:

a center contact configured to be terminated to a center conductor of a cable;

a dielectric holding the center contact;

an outer contact surrounding the dielectric and the center contact, the outer contact having an inner ferrule segment being configured to be terminated to a braid of the cable, the inner ferrule segment having an axially extending gap, the size of the gap is variable to change a diameter of the inner ferrule segment to control an impedance of the outer contact and the center contact; and an outer ferrule surrounding the inner ferrule segment of the outer contact such that the braid is sandwiched between the outer ferrule and the inner ferrule, the outer ferrule being crimped to control the size of the gap in the inner ferrule segment.

17. The connector assembly of claim 16, wherein the outer contact is stamped and formed from a flat workpiece having a first end and a second end, the outer contact being formed into a barrel shape such that the first end opposes the second end with a gap positioned between the first and second ends, the first end being variably positionable with respect to the second end to control the size of the gap.

18. The connector assembly of claim 16, wherein the gap follows a tortuous path defined by interdigitative fingers.

19. The connector assembly of claim 16, wherein outer ferrule is crimped to a predetermined crimp height, the crimp height corresponds with the size of the gap.

20. The connector assembly of claim 16, wherein as the gap closes, the inner ferrule segment is positioned closer to the center contact to lower the impedance between the outer contact and the center contact.

21. The connector assembly of claim 16, wherein as the gap closes, the effective dielectric constant between the center contact and the outer contact is changed to lower the impedance between the outer contact and the center contact.

22. The connector assembly of claim 16, wherein the outer ferrule has a hole therethrough, the hole is configured to allow a jacket of the cable to pass therein.

* * * * *